US006296128B1

(12) United States Patent
Isserstedt

(10) Patent No.: US 6,296,128 B1
(45) Date of Patent: Oct. 2, 2001

(54) STORAGE DEVICE

(76) Inventor: Robert Isserstedt, 6 Wilton Place, London SW1X 8RH (GB)

( * ) Notice: Subject to any disclaimer, the term of this patent is extended or adjusted under 35 U.S.C. 154(b) by 0 days.

(21) Appl. No.: 09/372,041

(22) Filed: Aug. 11, 1999

Related U.S. Application Data

(63) Continuation of application No. PCT/GB98/00466, filed on Feb. 13, 1998.

(30) Foreign Application Priority Data

Feb. 13, 1997 (GB) ..... 9702921

(51) Int. Cl.[7] ..... A47F 5/00

(52) U.S. Cl. ..... 211/113; 211/85.29; 211/118; 211/55

(58) Field of Search ..... 211/113, 118, 211/85.29, 85, 55, 10; 40/124.2; 206/425; 312/183, 184

(56) References Cited

U.S. PATENT DOCUMENTS

D. 347,447 * 5/1994 Isserstedt .
1,478,764 * 12/1923 Russell .
2,936,680 * 5/1960 Copen .
5,163,606 * 11/1992 Isserstedt ..... 40/124.2 X
5,385,245 * 1/1995 Waters ..... 211/113 X
5,487,617 * 1/1996 Cole et al. ..... 211/113 X
6,065,616 * 5/2000 Velles ..... 211/55

FOREIGN PATENT DOCUMENTS

652040 * 4/1951 (GB) .
1064546 * 4/1967 (GB) .

* cited by examiner

*Primary Examiner*—Robert W. Gibson, Jr.
(74) *Attorney, Agent, or Firm*—Bacon & Thomas PLLC

(57) ABSTRACT

A storage service comprises a support structure (1) carrying a plurality of receptacle (11) such as document pouches arranged in a longitudinal series. The support structure has a pair of spaced side members (4, 5) which are foldable so that the pouches may be arranged either in a closed up array or suspended in an openend out array. Support members (6) extend laterally between the side members (4, 5) and the pouches (11) are releasably supported on the support members and extend through gaps (3) between the support members. The pouches have closure flaps (15) which can be folded backwards over the support members (6) to suspend the pouches from them. A locating tab (10) may pass through an aperture (16) in the pouch and be folded over to hold the pouch to the support member (6). The support structure is made from a sheet of material provided with apertures (3) which define the side and support members (4, 5, 6).

10 Claims, 5 Drawing Sheets

FIG. 2.
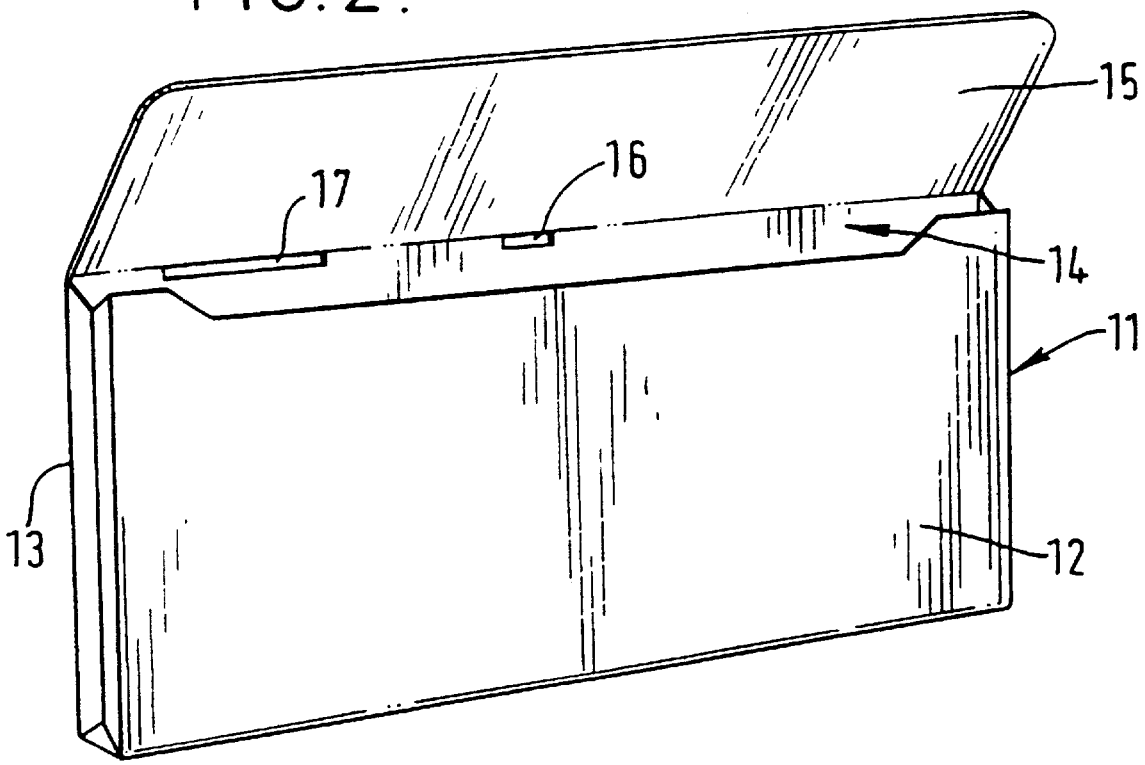
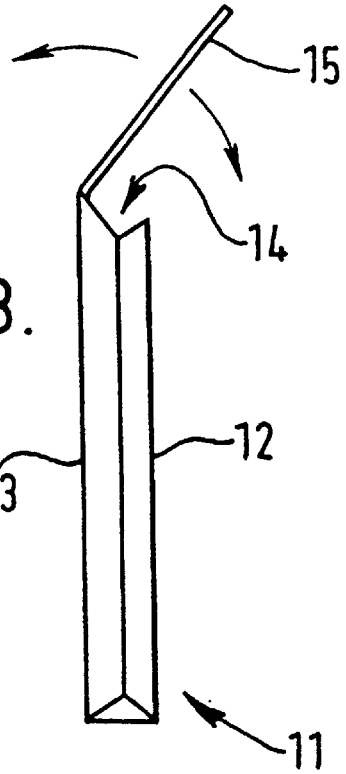
FIG. 3.

FIG. 6.
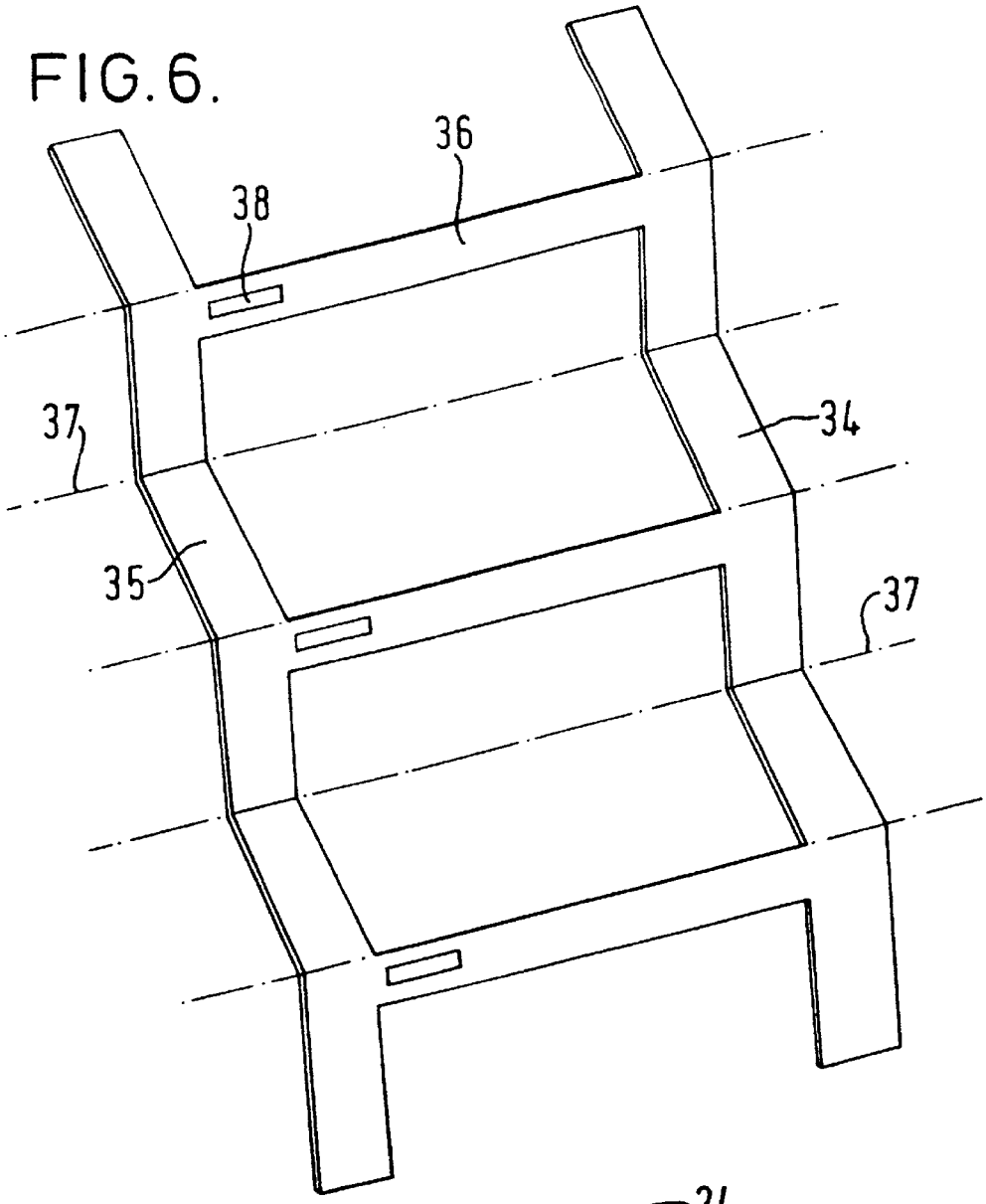
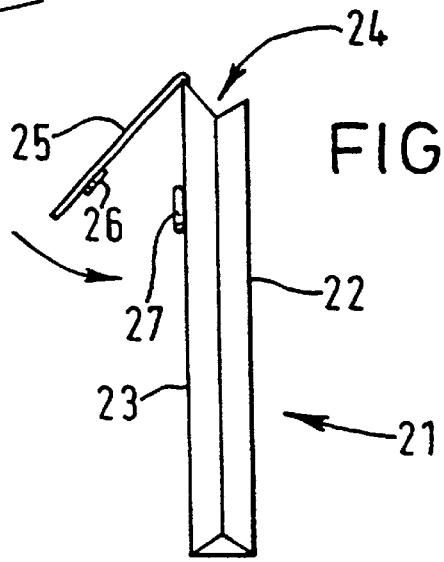
FIG. 7.

STORAGE DEVICE

This application is a Continuation of nonprovisional application Ser. No. PCT/GB98/00466 filed Feb. 13, 1998.

BACKGROUND OF THE INVENTION

1. Field of the Invention

This invention relates to a storage device, for example for documents and other articles. The invention is particularly concerned with a storage device having a support structure with detachable receptacles which can be arranged in a closed up array or opened out into a suspended array. The invention is also concerned with the support structure and the receptacles as separate articles.

2. Description of the Related Art

It is known from WO89/06601 to provide a storage device which has a plurality of removable pouches suspended from straps on either side which are foldable in a concertina manner in order that the pouches stack one in front of the other. The pouches may be conveniently stored in a box, bag or the like and extended vertically when desired in order to view and access the pouches and their contents. The pouches then hang from the device in a vertically overlapping manner. The pouches are independently removable from the device.

This arrangement has many advantages, particularly in neatly arranging and storing documents held in the pouches whilst travelling. Adjacent pouches do not support each others' weight, the weight of each pouch being carried by the straps on either side. The pouches are releasably fixed to the straps by means of a snap fastener arranged at either side of the upper edge of each pouch. In the preferred arrangements the upper edge is provided with a reinforcing member.

The preferred arrangement described in WO89/06601 has strong pouches, for example having rigid frames, but it has now been appreciated that an arrangement capable of using less sturdy pouches may be desirable in some contexts.

SUMMARY OF THE INVENTION

Viewed from one aspect the present invention provides a storage device comprising a support structure carrying a plurality of receptacles arranged in a longitudinal series, the support structure having a pair of spaced side members which are foldable so that the receptacles may be arranged either in a closed up array or suspended in an opened out array, characterised in that the support structure comprises a plurality of longitudinally spaced support members extending laterally between the side members and in that the receptacles are releasably supported on the support members and extend through gaps between the support members.

Thus, in contrast to the system in WO89/06601 the receptacles—such as pouches—are not just supported at their edges. There is a support structure which includes laterally extending support members serving to support the receptacles. The receptacles do not need to be of sufficient strength at their upper edges to be able to bear the weight of their contents without e.g. damage or undue distortion. Thus, for example, the receptacles may be relatively flexible pouches of paper or plastics. However, the invention is applicable to stronger receptacles, where the lateral support members may provide additional strength.

In a particularly preferred embodiment, the receptacles are document pouches of flexible sheet material such as paper or plastics, and have closure flaps along their upper edges which are folded back over the support members so that the pouches hang from the members.

As in WO89/06601, the side members may take a number of forms. They may be elongate flexible straps of e.g. webbing; or discrete flexible portions joined by rigid elements; or rigid portions hinged together; or, for example, strips of plastic which are provided with integrally formed hinges at suitable intervals. The lateral support members may be secured permanently or releasably to the side members, or may be formed integrally therewith. The side members may be in the form of portions which are hingedly connected between adjacent support members. The folding of the structure may be achieved simply by hinging where the side members meet the support members, or by having intermediate fold lines for the side members between the support members.

In a preferred arrangement the support structure is formed from a single sheet of material with the support members being defined between longitudinally spaced apertures formed therein. This arrangement is advantageous in that it is particularly simple to manufacture if, for example, the apertures are stamped out of the sheet of flexible plastics material. Hinges can be formed by pressing material where the side member portions meet the support members, thus providing a simple way of ensuring that the structure can be folded as desired. It is also simple to choose the size of the support structure by using a different size of sheet. Thus, support structures may be manufactured for use with receptacles of different types and sizes. For example pouches for holding CD's, photographs etc. could be used with a suitably sized frame.

The support structure may of course be supplied for users to attach their own receptacles such as document wallets. Thus viewed from another aspect of the invention there is provided a support structure for carrying a plurality of receptacles arranged in a longitudinal series, the support structure having a pair of spaced side members which are foldable so that in use the receptacles may be arranged either in a closed up array or suspended in an opened out array, characterised in that the support structure comprises a plurality of longitudinally spaced support members extending laterally between the side members, on which the receptacles may be releasably supported.

The receptacles will in general need to be supported over at least a major part of their width by the support members. This could be achieved for example by a series of laterally spaced fasteners along the support member and receptacle, such as snap fasteners or patches of hook and loop fastener, or by a laterally extending strip of hook and loop fastener or a releasable adhesive. Preferably, however, the receptacle is provided along its upper edge with a flap which may be folded over the support member.

The flap could be provided just for securing purposes but in a preferred embodiment the receptacle is provided at its upper edge with a flap which may be folded between two positions. In the first position the flap overlies the front face of the receptacle, covering an opening which for access to the interior of the receptacle. This would be the state of the receptacle when removed from the support structure for individual use or transportation. In the second it is folded back over a support member to overlie the rear face of the receptacle, thus supporting the receptacle on the member. It will thus be apparent that a conventional type of document wallet with a closure flap could be used as a receptacle without any modifications. Means could be provided to secure the flap to the rear face of the receptacle, such as a snap fastener or a hook and loop fastener with one portion on the front face of the flap and one portion on the rear face of the receptacle, or a patch of releasable low tack adhesive on at least one of these faces, a tongue cut-out from the flap of the pouch in order to be inserted into a corresponding slot on the rear face of the pouch, or vice versa. Furthermore, rather than securing the flap to the back of the pouch, it could instead be secured to the horizontal bar itself.

Such a receptacle is itself novel and thus viewed from another aspect the present invention provides a receptacle having front and rear faces, a top edge, an opening adjacent the top edge providing access to the interior of the receptacle, and a flap hinged to the top edge so as to be movable between a first position in which it overlies the front face of the receptacle and at least partially closes the opening, and a second position in which it overlies the rear face of the receptacle so as to provide access to the opening, characterised in that fastening means are provided on at least one of the flap and the rear face of the receptacle for fastening the flap in said second position.

Preferably, means are provided to position the receptacle correctly with respect to the support member, normally centrally. Where the receptacle is attached by individual fasteners, such as snap fasteners, these would be positioned at the appropriate positions to ensure that the receptacle will be in the correct location. Where the receptacle is attached by means of a flap folded over the support member, then if that flap has a width substantially equal to the spacing between the side members then it will be suitably located between them. Additionally, or alternatively, there could be a protrusion on the support member which engages through an aperture on the receptacle to locate it in the correct lateral position. In a preferred embodiment, the protrusion is a tab extending from the upper edge of the support member, and the aperture is provided in the region where the flap is hinged to the remainder of the receptacle. The tab could be a specific tab for locating purposes. Additionally or alternatively it could be a tab intended to carry a label or the like.

Such a receptacle is itself novel and thus viewed from another aspect the present invention provides a receptacle having front and rear faces, a top edge, an opening adjacent the top edge providing access to the interior of the receptacle, and a flap hinged to the top edge so as to be movable between a first position in which it overlies the front face of the receptacle and at least partially closes the opening, and a second position in which it overlies the rear face of the receptacle so as to provide access to the opening, characterised in that an aperture is provided in the top edge of the receptacle in the region where the flap is hinged to the rear face of the receptacle, the aperture passing through material of the rear face of the receptacle and/or material of the flap.

When the storage device is to be manipulated into the closed up array from the suspended opened out array, a user will often try to achieve this by pushing up on one or more receptacles. Where a receptacle is attached using a flap arrangement as discussed above, the receptacle will tend to lift off from its support member. This could cause difficulties and could even lead to the receptacle being detached from the support member. If the flap is secured to the rear face of the receptacle, then the fastening region will eventually engage the underside of the support member to prevent detachment of the receptacle. The amount by which it lifts is determined by the position of the fastening region, and the nearer it is to the upper edge of the receptacle the less lift there will be. Thus, preferably releasable means are provided to restrain the receptacle against upwards movement away from the support member. Whilst such means could be provided by fastening the flap to the rear face of the receptacle as described above, preferably more specific means are provided.

Accordingly, in a preferred arrangement, the support member is provided with releasable locating means for restricting movement of the receptacle away from the support member. In the preferred embodiment the locating means comprises a hinged element such as a tab which extends through an aperture in a receptacle which has a flap folded over the support member, the element being movable between a first position in which it extends away from the support member so the receptacle may be positioned on the support member with the aperture passing over the element, and a second position in which the element passes through the aperture and is bent over the receptacle and support member to restrain movement of the receptacle away from the support member.

Such a hinged element may also serve as the tab described earlier to position the receptacle centrally. The apertured receptacle may be as described earlier in connection with cooperation with such a tab. Preferably the hinged element is of plastics material or the like, and is preferably integral with the support member. Where the support structure is formed from a single piece of material, the hinged element can be formed at the same time as the other components.

In the closed up condition, the support structure and receptacles may be stored in a bag, case, box, desk drawer or other suitable container or enclosure. When in the opened out condition the structure may be suspended from a hook, door frame or the like, and preferably is provided with suitable suspension means such as a hook to permit this to be done. In the suspended condition the receptacles should hang so that there is access to the opening of each. This means that each receptacle needs to hang from its support member with an upper portion accessible and a lower portion behind the receptacle and support member below. The width of the receptacle must not therefore exceed the free space between the side members of the support frame, so that it can pass through the aperture defined between adjacent support members.

As noted above, in a preferred embodiment the support structure is manufactured from a single sheet of material, and this may be plastics, cardboard or any other material having sufficient strength for the purpose intended. This is a simple and inexpensive way of producing a support structure, and thus is of applicability to storage devices which require such a structure but do not need releasable receptacles. The receptacles could be glued, bonded or otherwise attached to the support members. Possibly, suitable receptacles could be formed integrally with the support members.

Thus, viewed from another aspect the present invention provides a storage device comprising a support structure carrying a plurality of receptacles arranged in a longitudinal series, the support structure having a pair of spaced side members which are foldable so that the receptacles may be arranged either in a closed up array or suspended in an opened out array, characterised in that the support structure comprises a plurality of longitudinally spaced support members, extending laterally between the side members, to which the receptacles are attached, and in that the support structure comprises a sheet of material provided with a series of longitudinally spaced, laterally extending apertures which define the side members and the support members.

Viewed from a still further aspect the present invention provides a method of manufacturing a storage device comprising a support structure carrying a plurality of receptacles arranged in a longitudinal series, the support structure having a pair of spaced side members which are foldable so that the receptacles may be arranged either in a closed up array or suspended in an opened out array, characterised in that a sheet of material is provided with a series of longitudinally spaced, laterally extending apertures which define the side members and a plurality of longitudinally spaced support members which extend laterally between the side members, and in that the receptacles are attached to the support members.

In the preferred embodiments of the present invention, the side members, support members, and receptacles are of generally rectangular form, and appropriate components are perpendicular to each other. However, other shapes and configurations are possible.

BRIEF DESCRIPTION OF THE DRAWINGS

Certain preferred embodiments of the present invention will now be described, by way of example only, with reference to the accompanying drawings in which:

FIG. 2 is a perspective view of a receptacle for use with the structure of FIG. 1;

FIG. 3 is a side view of the receptacle;

FIG. 6 is a partial view of an alternative support structure, in a partially closed up position; and FIG. 7 is a side view of an alternative receptacle.

DETAILED DESCRIPTION OF THE PREFERRED EMBODIMENTS

Figure 1:
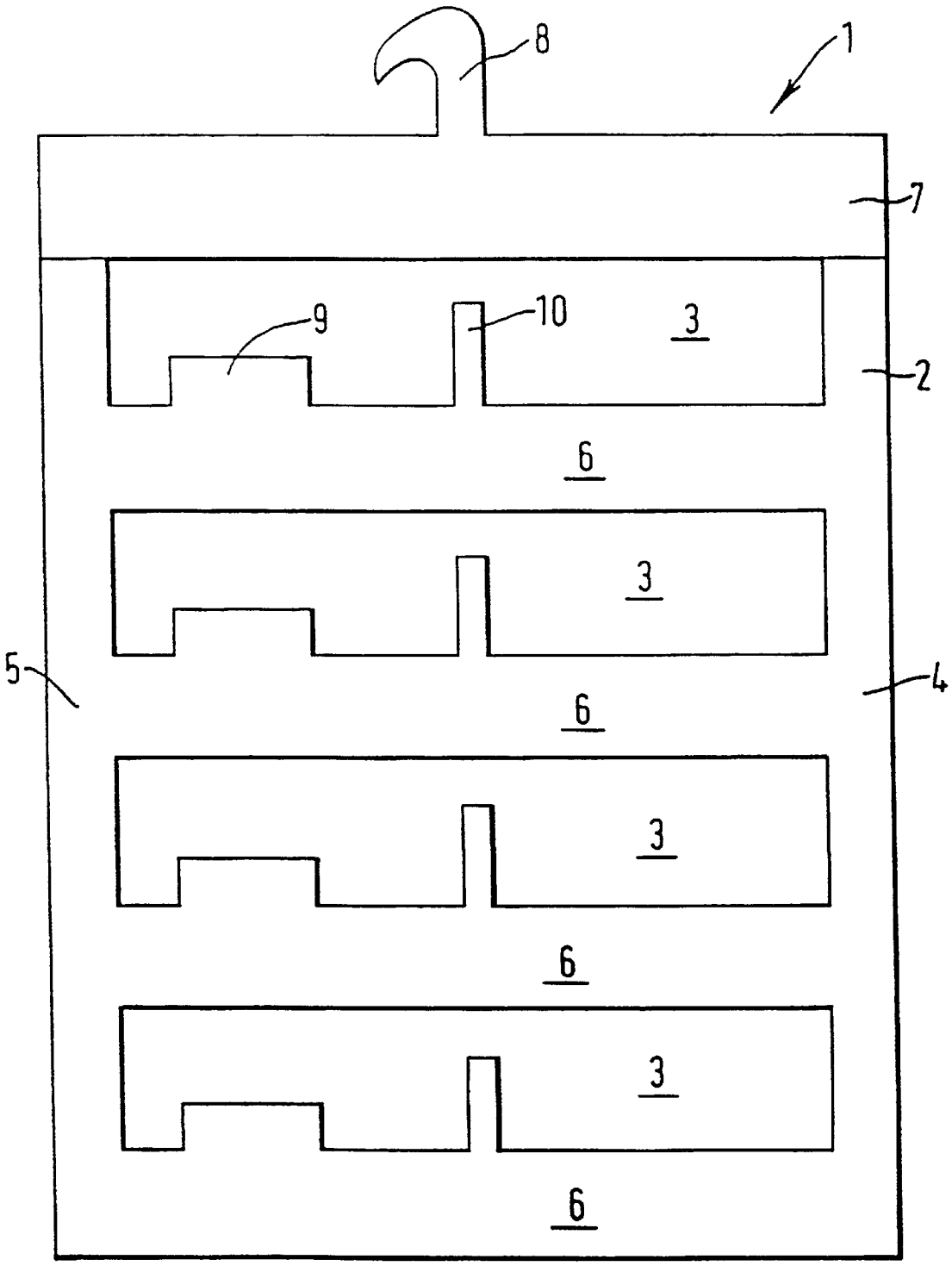
FIG. 1 is a front view of a storage device support structure embodying the present invention.

Turning to FIG. 1, a support structure 1 comprises a rectangular sheet 2 of flexible plastics material. This sheet is provided with a number of identical longitudinally spaced, laterally extending rectangular apertures 3, which have been removed from the sheet in the manufacturing process. These define a pair of parallel longitudinal side members 4 and 5, interconnected by laterally extending support members 6 which are to be used to support receptacles in the form of pouches. At its upper end the sheet 2 is bonded to a cross bar of a support hanger 7 provided with a hook 8 so that the structure may be suspended vertically from any suitable point eg. a clothes rail in a wardrobe or a hook on a door, wall etc. The support hanger 7 and the hook 8 may be hinged so as to fold behind the structure for storage. They may be of a suitable rigid plastics material.

Each support member 6 is provided with a label tab 9 on its left hand side and a centrally positioned locating tab 10 projecting upwardly from its upper edge. Both of these are formed integrally from the sheet of material. The label tag 9 is adapted to receive e.g. an adhesive label. The locating tab 10 is hinged to the support member 6, the hinge being formed by pressing during the manufacturing process.

The arrangement shown in FIG. 1 is only diagrammatic, with only four support members 6. In a practical embodiment, there might be ten or more.

In FIGS. 2 and 3 there is shown a receptacle in the form of a gusseted document pouch 11, of generally conventional type. This has a front face 12, a rear face 13, an opening 14 adjacent its upper edge, and a flap 15 hinged to the rear face along the upper edge. This flap can overlie the front face to cover the opening 14, and can also be folded back to overlie the rear face of the pouch. In the region of the hinge there is provided a centrally positioned aperture 16 for receiving the locating tab 10 of a support member 6 of the support structure. There is also provided a larger aperture 17 at one side, to receive the label tab 9 of the support member.

Figure 4:
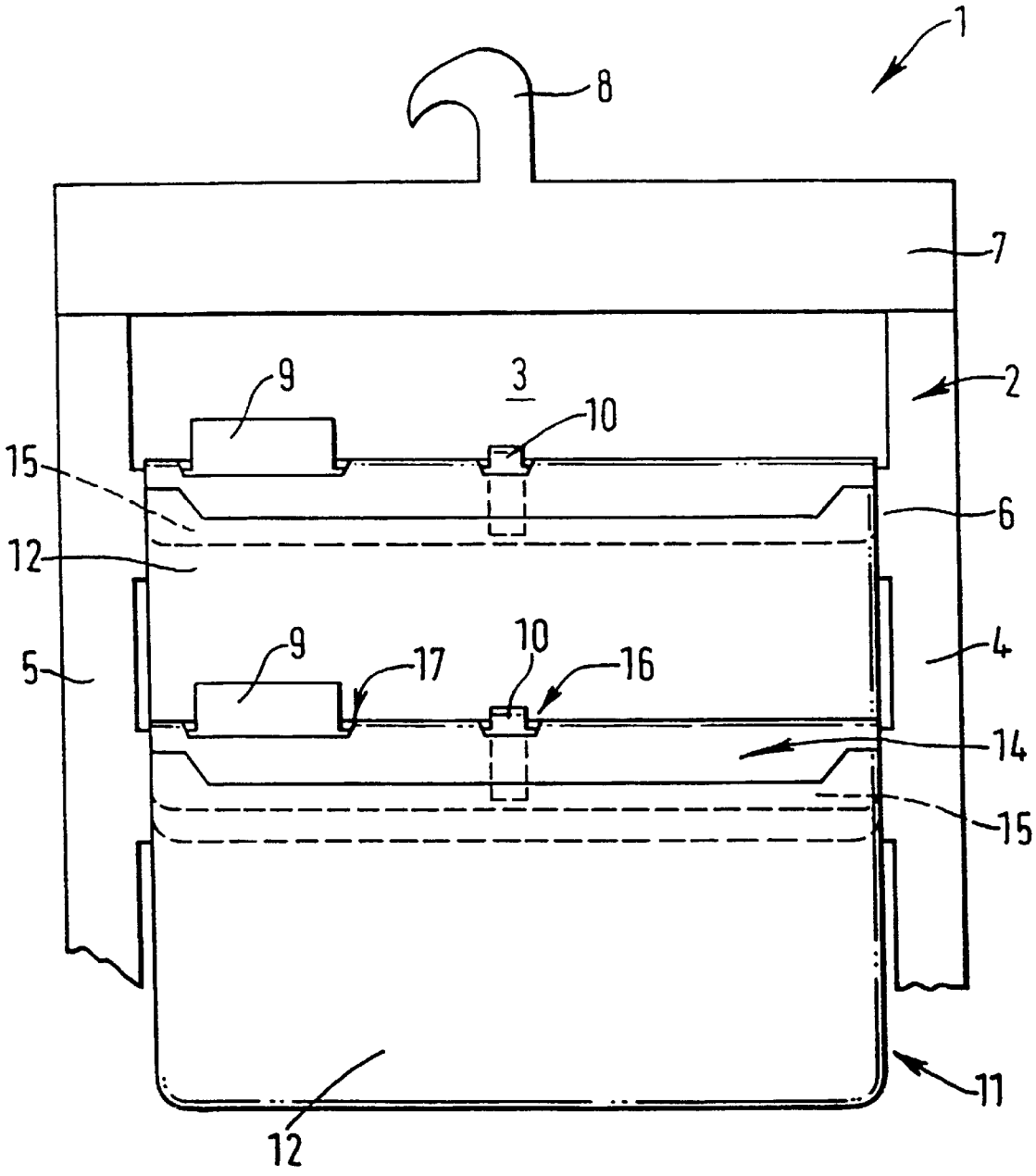
FIG. 4 is a partial front view of the structure of FIG. 1 with receptacles in position, suspended in an opened up array.

FIG. 4 shows a portion of the support structure 1 in the suspended condition of FIG. 1, but with pouches 11 in place. Pouches may be secured over any or all of the horizontal support members as desired. Each pouch has had its flap 15 folded back to overlie its rear face, and has then been placed on the support member 6. The label tab 9 passes through the aperture 17, and the locating tab 10 passes through the aperture 16. The locating tab has then been hinged backwards to overlie the rear face and resist vertical movement of the pouch away from the support member. The support member 6 is disposed between the flap and the rear face of the pouch, and the hinge region of the pouch rests on the support member. Lateral movement of the pouch is resisted by the tabs engaging in the apertures 16 and 17, and by the sides of the pouch engaging the side members of the support structure.

An upper region of each pouch, with the opening 14, is accessible. A lower region passes through the gap between adjacent support members, namely one of the apertures 3 of the support structure, so as to pass behind the support member and pouch below. Each pouch can be accessed and each can be removed or replaced without disturbing the others. The weight of the pouches is borne by the support structure and is not transferred to the pouches above.

Figure 5:
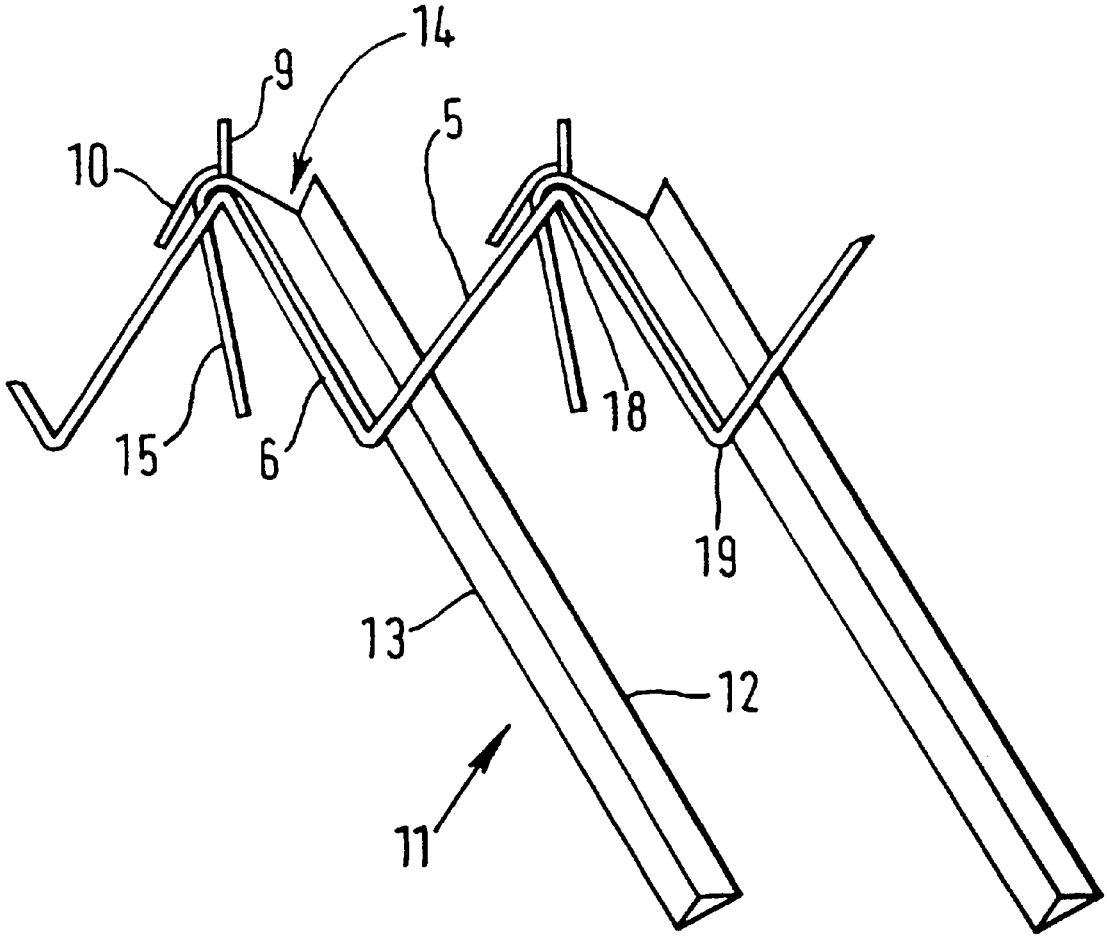
FIG. 5 is a partial side view of the structure of FIG. 1 with receptacles in position, in a partially closed up array.

FIG. 5 shows the support structure and pouches in a closed up array. The side members 4 and 5 have been folded, by being hinged at points 18 and 19 where they meet the support members. In this condition the structure can be stored in a case, filing drawer and so forth as desired. The pouches can still be accessed, removed or replaced. This view shows how the locating tab 10, passing through aperture 16, has been folded back to resist vertical movement of the pouch away from the support member. In some cases the front face of the pouch above may assist in keeping the locating tab 10 in this condition, if the array is closed up further. It may not be necessary to have the tabs 10 overlying the rear face 13, and they may just project rearwardly from the support members.

FIG. 6 shows part of an alternative support structure with side members 34 and 35, and support members 36. In this arrangement the side members do not just fold along transverse lines where they meet the support members 36. They also fold along intermediate lines 37, midway between the support members. In this embodiment there are no label tabs. Display means such as a wipe-clean label 38 are provided on the support members. These could be used to display information about the contents of the pouch normally secured over the corresponding member, making it easy to tell at a glance which pouches have been removed to reveal the corresponding labels.

FIG. 7 shows an alternative receptacle, still in the form of a gusseted document pouch 21 of generally conventional type. This has a front face 22, a rear face 23, an opening 24 adjacent its upper edge, and a flap 25 hinged to the rear face along the upper edge. This flap can overlie the front face to cover the opening 24, and can also be folded back as shown to overlie the rear face of the pouch. The front face of the flap 25 is provided with fastening means or device 26, such as a snap fastener portion, and the rear face of the pouch is provided with cooperating means or device 27 so that the flap can be releasably fastened to the rear face of the pouch, over a support member.

The storage device described above can be used for long or short term storage of items, as well as their transportation or display. Transparent pouches, for example, could be used for displaying items Although certain preferred embodiments of the present invention have been shown and described, it will be apparent to those skilled in the art that other modifications may be made without departing from the scope of the invention.

What is claimed is:

1. A storage device comprising a support structure carrying a plurality of receptacles arranged in a longitudinal series, the support structure having a pair of spaced side members which are foldable so that the receptacles may be arranged either in a closed up array with the side members folded in a concertina fashion or suspended in an opened out array with the side members extended, wherein the support structure comprises a plurality of longitudinally spaced support members extending laterally between the side members, the spacings between the support members defining rectangular gaps which have laterally extending sides defined by portions of the support members and longitudinally extending sides defined by portions of the side members, and wherein the receptacles are releasably supported on the support members and extend through the rectangular gaps between the support members, each receptacle having a top edge and a front portion extending from the top edge and each receptacle being supported by a part of the receptacle extending from the top edge through the gap which is defined between the support member on which the receptacle is supported and the support member above, the front portion of the receptacle passing through the gap which is defined between the support member on which the receptacle is supported and the support member below.

2. The storage device as claimed in claim 1, wherein the support structure comprises a sheet of flexible material with the support members and side members being defined between longitudinally spaced ones of the gaps formed in the sheet.

3. The storage device as claimed in claim 1, wherein each receptacle has a flap extending from the top edge and over one of the support members.

4. A storage device comprising a support structure carrying a plurality of receptacles arranged in a longitudinal series, the support structure having a pair of spaced side members which are foldable so that the receptacles may be arranged either in a closed up array or suspended in an opened out array, wherein the support structure comprises a plurality of longitudinally spaced support members extending laterally between the side members and the receptacles are releasably supported on the support members and extend through gaps between the support members, the support structure being formed from a sheet of flexible material with the support members and side members being defined between longitudinally spaced apertures formed therein which define the gaps between the support members, and wherein each receptacle has a flap extending over a support member and has a rear face, a top edge, and an opening adjacent the top edge, the flap being hinged to the rear face adjacent the top edge so as to be movable between a first position in which it covers the opening when the receptacle is removed from the support structure, and a second position in which it extends over a support member.

5. The storage device as claimed in claim 4, wherein the support members are provided with a releasable locating device for restricting movement of the receptacles away from the support members.

6. The storage device as claimed in claim 5, wherein the releasable locating device comprises a foldable tab positioned on at least one of the support members which passes through a first aperture in the region where the flap is hinged to the rear face.

7. The storage device as claimed in claim 5, wherein at least one of the support members is provided with a label tag which passes through a second aperture in the region where the flap is hinged to the rear face.

8. The storage device as claimed in claim 4, wherein a releasable fastening device is provided between the flap and the rear face for fastening the flap to the rear face of the receptacle.

9. A receptacle for use with a storage structure which can carry a plurality of such receptacles arranged in a longitudinal series on a plurality of longitudinally spaced support members with the receptacles releasably supported on the support members and extending through gaps between the support members, each of the receptacles having front and rear faces, a top edge, an opening adjacent the top edge providing access to the interior of the receptacle, and a flap hinged to the top edge so as to be movable between a first position in which it overlies the front face of the receptacle and at least partially closes the opening, and a second position in which it overlies the rear face of the receptacle so as to provide access to the opening, wherein at least one aperture is provided in the top edge of the receptacle in the region where the flap is hinged to the rear face of the receptacle, the aperture passing through material of the rear face of the receptacle and/or material of the flap and being adapted to receive a tab on a support member of the support structure.

10. A receptacle for use with a storage structure which can carry a plurality of such receptacles arranged in a longitudinal series on a plurality of longitudinally spaced support members with the receptacles releasably supported on the support members and extending through gaps between the support members, the receptacle having front and rear faces, a top edge, an opening adjacent the top edge providing access to the interior of the receptacle, and a flap hinged to the top edge so as to be movable between a first position in which it overlies the front face of the receptacle and at least partially closes the opening, and a second position in which it overlies the rear face of the receptacle so as to provide access to the opening, wherein a releasable fastening device is provided between the flap and the rear face for fastening the flap to the rear face of the receptacle.

* * * * *